US006077199A

United States Patent [19]

Hsu

[11] Patent Number: 6,077,199

[45] Date of Patent: Jun. 20, 2000

[54] JOGGING MACHINE

[76] Inventor: Hank Hsu, 8-F-14, No. 16, Lane 609, Sec. 5 Chung Hsin Rd., San Chung, Taiwan

[21] Appl. No.: 09/201,252

[22] Filed: Nov. 30, 1998

[51] Int. Cl.[7] ..... A63B 21/08

[52] U.S. Cl. ..... 482/54; 482/133

[58] Field of Search ..... 482/51, 54, 133

[56] References Cited

U.S. PATENT DOCUMENTS 5,860,894 1/1999 Dalebout et al. ..... 482/54

*Primary Examiner*—Glenn E. Richman
*Attorney, Agent, or Firm*—Browdy and Neimark

[57] ABSTRACT

A jogging machine consists of a base, a jogging belt device, and a pulling device. The base is used to support the jogging belt device and the pulling device on the floor. The jogging belt device is composed of a support frame which is pivoted at one end to the base such that other end of the support frame is rested on the floor, and that the jogging belt device is rested stably and slantingly on the floor. The pulling device is composed of a guide rod, which is fastened at one end thereof with the base, and a sliding member mounted on the guide rod such that the sliding member is capable of a reciprocating motion along the longitudinal direction of the guide rod, and that the sliding member is kept at a first position on the guide rod by an elastic member. The sliding member can be forced to slide away from the first position by an external force greater than the elastic force of the elastic member and exerting on a pulling member which is connected with the sliding member. When the external force exerting on the pulling member becomes smaller than the elastic force of the elastic member, the sliding member is pulled by the elastic force of the elastic member to slide back to the first position.

3 Claims, 4 Drawing Sheets

JOGGING MACHINE

FIELD OF THE INVENTION

The present invention relates generally to an exercise machine, and more particularly to an improved jogging machine.

BACKGROUND OF THE INVENTION

There are a variety of indoor exercise machines currently available in the market place for the consumers to choose from. These conventional indoor exercise machines are generally bulky and designed for the user to engage in only one form of exercise. As a result, the consumers are forced to buy several different kinds of exercise machines, which can add up to a small fortune and take up a lot of storage space on the floor of a room.

SUMMARY OF THE INVENTION

It is therefore the primary objective of the present invention to provide an improved jogging machine which is designed for use as a jogging machine and an arm building machine.

In keeping with the principle of the present invention, the foregoing objective of the present invention is attained by the jogging machine consisting of a base, a jogging belt device, and a pulling device. The base is used to support the jogging belt device and the pulling device on the floor. The jogging belt device is composed of a support frame which is pivoted at one end to the base such that other end of the support frame rests on the floor, and that the jogging belt device rests stably and slantingly on the floor. The pulling device is composed of a guide rod, which is fastened at one end thereof with the base, and a sliding member mounted on the guide rod such that the sliding member is capable of sliding back and forth along the direction of the longitudinal axis of the guide rod, and that the sliding member is kept at a first position on the guide rod by an elastic member. The sliding member can be forced to slide away from the first position by an external force greater than the elastic force of the elastic member and exerting on a pulling member which is connected with the sliding member. When the external force exerting on the pulling member becomes smaller than the elastic force of the elastic member, the sliding member is pulled by the elastic force of the elastic member to slide back to the first position.

The forgoing objective, features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
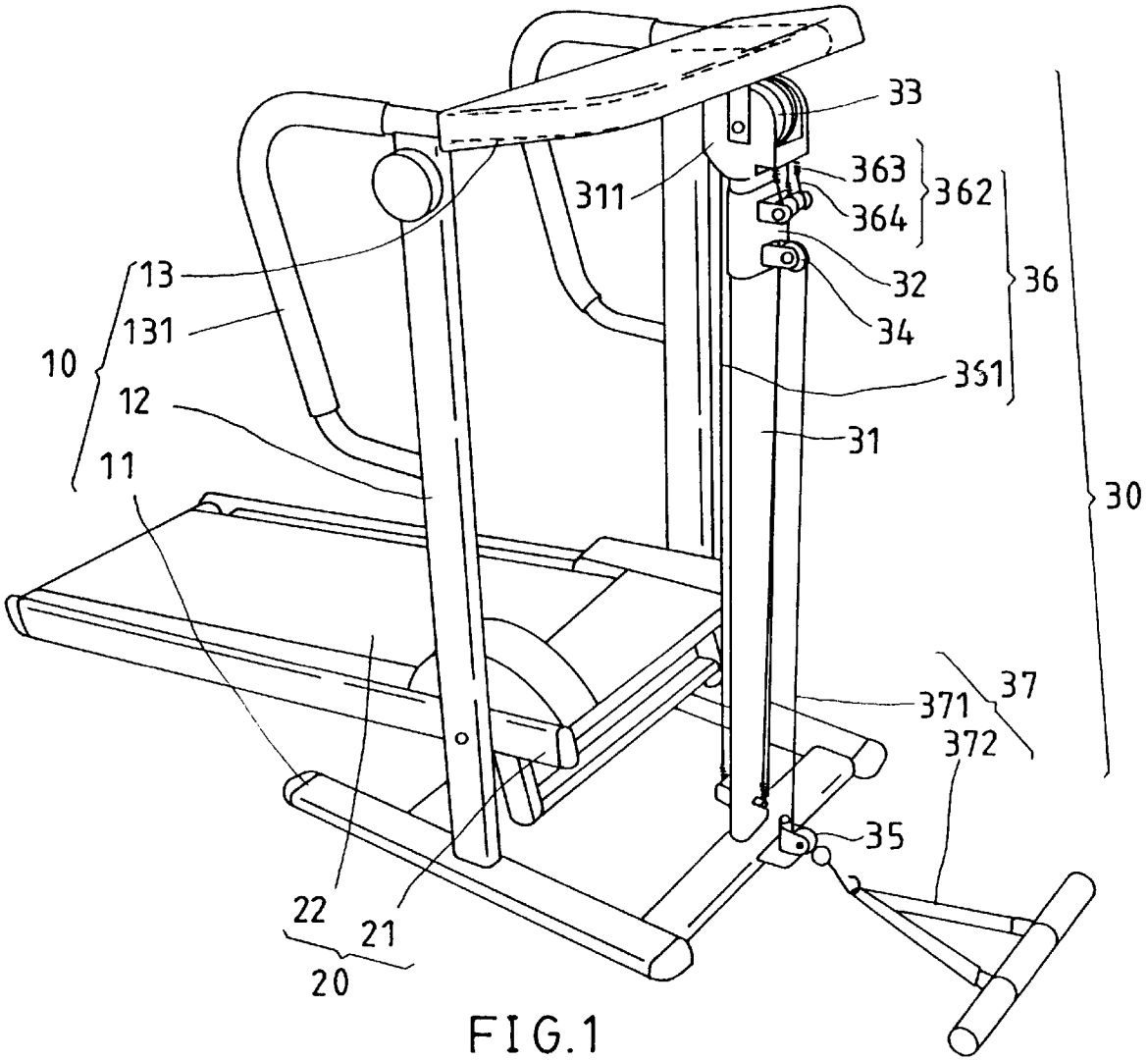
FIG. 1 shows a perspective view of the preferred embodiment of the present invention.

As shown in FIG. 1, a jogging machine 1 embodied in the present invention is composed of a base 10, a jogging belt device 20, and a pulling device 30.

The base 10 has a bottom support 11 of a framelike construction, two support rods 12 are uprightly fastened with the bottom support 11 such that the two support rods 12 are located symmetrically, and a rail 13 fastened at both ends thereof with the top ends of the two support rods 12 such that both ends of the rail 13 extend respectively to form a grip 131.

The jogging belt device 20 has a support frame 21, a plurality of rolling shafts (not shown in the drawing) pivoted to the support frame 21 in a parallel manner, and an endless belt 22 that can move continuously on the rolling shafts. The support frame 21 is fastened pivotally at one end thereof with the support rods 12 such that other end of the support frame 21 rests on the floor surface, and that the jogging belt device 20 is slantingly rested on the floor surface.

The pulling device 30 has a guide rod 31 which is fastened at the bottom end thereof with the bottom support 11 and is provided at the top segment thereof with a pivoting seat 311 which is in turn fastened at the top end thereof with the midsegment of the rail 13. The guide rod 31 is fitted into a sliding member 32 of a sleevelike construction. The sliding member 32 is capable of a reciprocating motion along the direction of the longitudinal axis of the guide rod 31. Three rolling wheels 33 are pivoted side by side in the pivoting seat 311 of the guide rod 31. A pulley 34 is pivoted to the sliding member 32. A small rolling wheel 35 is pivoted to the bottom support 11 such that the small rolling wheel 35 is contiguous to the bottom end of the guide rod 31. Three elastic members 36 have an elastic cord 361 and a connection member 362. The connection member 362 has a head portion 363 and a hooked portion 364. The elastic cord 361 is connected at one end thereof with the proximity of the bottom end of the guide rod 31 such that the elastic cord 361 runs through the rolling wheel 33 corresponding in location to the elastic cord 361, and that the elastic cord 361 is connected at other end thereof with the head portion 363 of the connection member 362 via the underside of the pivoting seat 311, and further that the sliding member 32 is caught by the hooked portion 364 of the connection member 362. As a result, the sliding member 32 can be kept at a first position on the guide rod 31. A pulling member 37 has a cord body 371 and a pull handle 372. The cord body 371 is connected at one end thereof with the bottom support 11 such that the cord body 371 runs through the pulley 34 and the small rolling wheel 35, and that the cord body 371 is connected at other end thereof with the pull handle 372.

Figure 2:
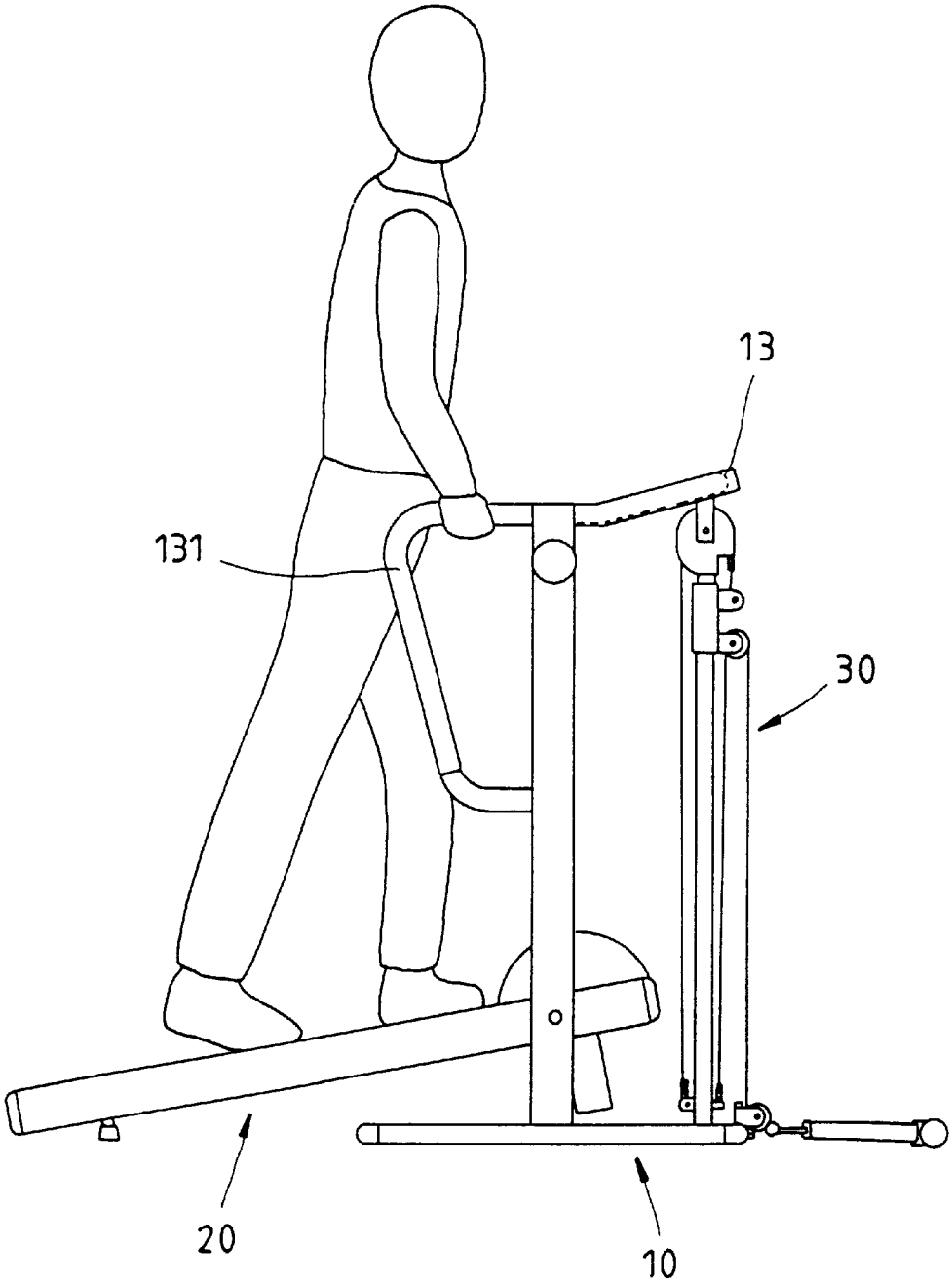
FIG. 2 shows a schematic view of the preferred embodiment of the present invention in use.
Figure 3:
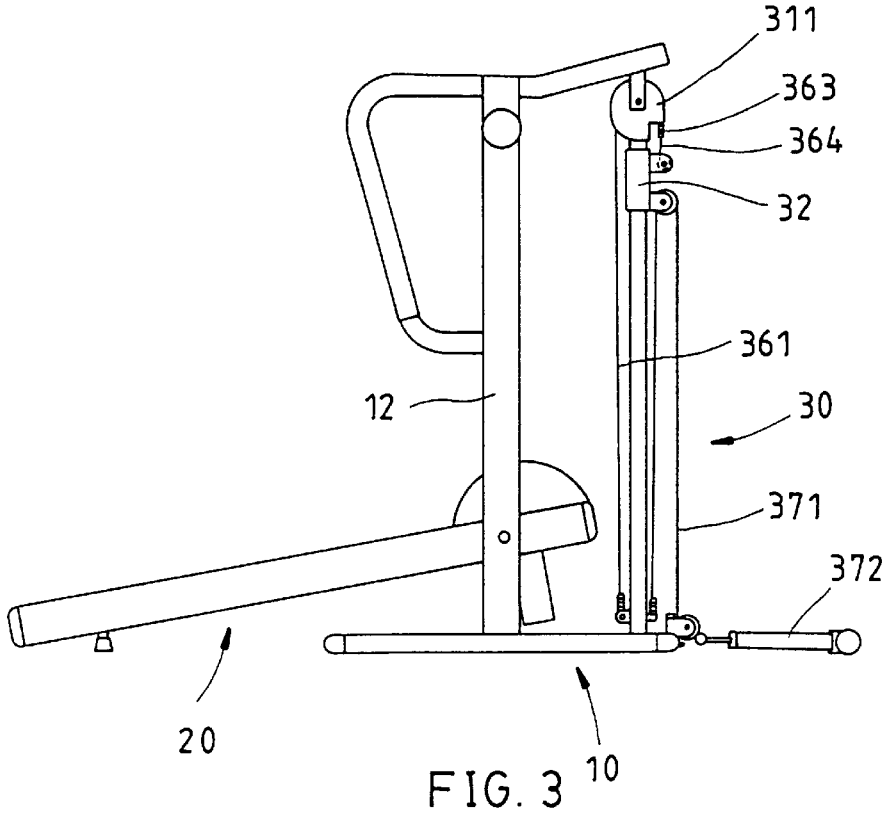
FIGS. 3–4 shows schematic views of the preferred embodiment of the present invention in action.
Figure 4:
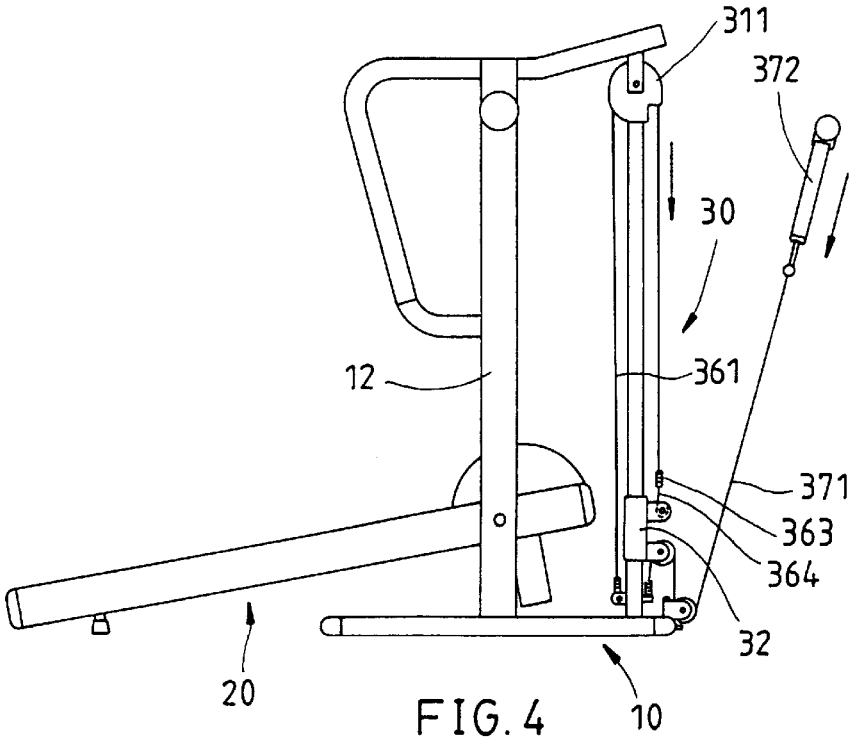

Now referring to FIGS. 2–4, the jogging machine 1 of the present invention is shown to have dual functions of the jogging exercise and the pulling exercise. As shown in FIG. 2, an exerciser stands on the belt 22 of the jogging belt device 20, with both hands of the exerciser holding the grip 131. As both legs of the exerciser engage in jogging on the belt 22, the endless belt 22 is moved continuously on the rolling shafts. As a result, the jogging machine 1 of the present invention can be used by a person to engage in an exercise mimicking the jogging.

As shown in FIGS. 3 and 4, the jogging machine 1 of the present invention is used to bring about another form of exercise. Both hands of an exerciser hold the pull handle 372 and then pull the pull handle 372. When the pulling force of both hands of the exerciser overcomes the total elastic force of the elastic cords 361, the cord body 371 actuates the sliding member 32 to slide along the direction of the longitudinal axis of the guide rod 31 such that the sliding member 32 moves away from the first position. When the pulling force exerting on the pull handle 372 becomes smaller than the total elastic force of the elastic cords 361, the sliding member 32 is forced by the total elastic force of the elastic cords 361 to slide along the original path to return to the first position. The arm or chest building exercise can be thus brought about by pulling repeatedly the pull handle 372 with both hands.

The elastic force of the elastic member 36 can be adjusted by moving one of the hooked portions 364 of the elastic members 36 away from the sliding member 32, so as to relieve partially the sliding member 32 of the elastic force exerting thereon. The head portion 363 of the connection member 362 of the elastic member 36 that is moved away from the sliding member 32 urges the underside of the pivoting seat 311.

Figure 5:
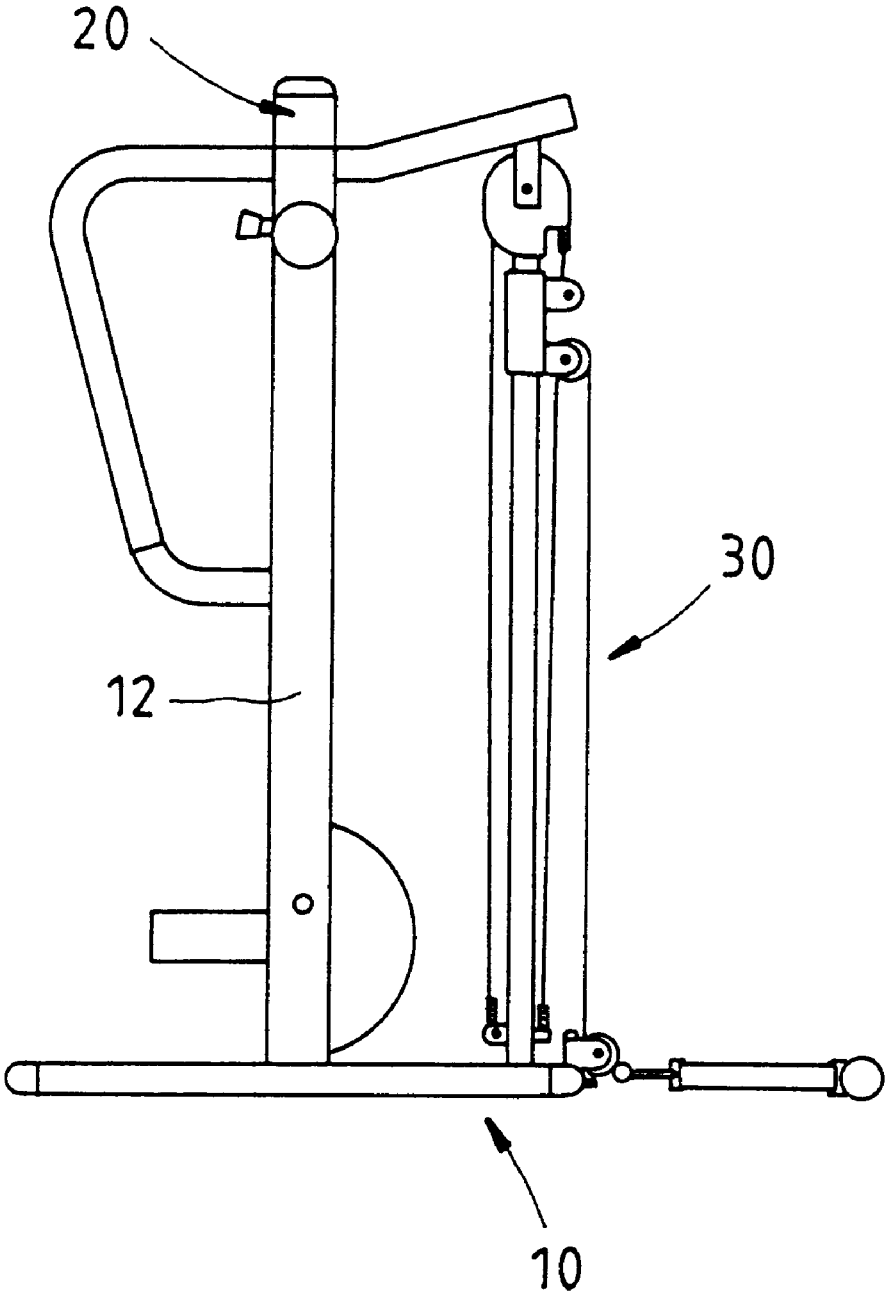
FIG. 5 shows a schematic view of the preferred embodiment of the present invention in the folded state.

As shown in FIG. 5, the jogging machine 1 of the present invention can be folded to reduce its volume. The reduction in volume of the jogging machine 1 is attained by folding the jogging belt device 20 to locate between the two support rods 12 of the base 10.

The embodiment of the present invention described above is to be deemed in all respects as being merely illustrative and not restrictive. Accordingly, the present invention may be embodied in other specific forms without deviating from the spirit thereof. The present invention is therefore to the limited only by the scopes of the following appended claims.

What is claimed is:

1. A jogging machine comprising:

a base resting on a surface;

a jogging belt device having a support frame, a plurality of rolling shafts pivoted to said support frame in a parallel manner, and an endless belt that can move continuously on said rolling shafts, said support frame fastened pivotally at one end thereof with said base such that other end of said support frame rests on the surface on which said base is rested, and that said jogging belt device is slantingly rested on the surface;

wherein said base is provided with a pulling device mounted thereon, said pulling device having a guide rod which is fastened at a bottom end thereof with said base, said pulling device further having a sliding member which is fitted slidably over said guide rod such that said sliding member is capable of a reciprocating motion along the direction of a longitudinal axis of said guide rod, and that said sliding member is exerted on by an elastic force of at least one elastic member to remain at a first position on said guide rod, said sliding member being fastened with a pulling member (37) such that said sliding member is pulled away from said first position at the time when an external force exerting on said pulling member is greater than the elastic force exerting on said sliding member, and that said sliding member is pulled by the elastic force to return to said first position at the time when the elastic force is greater than the external force, or at the time when the elastic force is greater than the external force, or at the time when the pulling member is completely relieved of the external force exerting thereon;

wherein said guide rod is pivoted at a top end thereof with at least one rolling wheel; wherein said elastic member has a first cord body (361) and a connection member (362), said first cord body (361) of said elastic member connected at a first end thereof with a proximity of a bottom end of said guide rod, a second end of said first cord body (361) being connected with said connection member (362) via said rolling wheel, said connection member (362) connected with said sliding member for keeping said sliding member at said first position; wherein said sliding member is provided with a pulley pivoted thereto; and wherein said pulling member (37) has a second cord body (371) and a pull handle, said second cord body (371) connected at a first end thereof with a proximity of a bottom end of said guide rod such that said second cord body runs through said pulley (34), and that a second end of said second cord body is connected with said pull handle.

2. The jogging machine as defined in claim 1, wherein said bottom support is provided with a small rolling wheel pivoted thereto; and wherein said second cord body runs through said pulley and said small rolling wheel in that order from the first end of the second cord body.

3. The jogging machine as defined in claim 1, wherein said guide rod is provided at a top segment thereof with a pivoting seat; wherein said rolling wheel is pivoted to said pivoting seat; wherein said connection member (362) has a head portion (363) and a hooked portion (364), said head portion being connected with said first cord body (361) said hooked portion being engaged with said sliding member; and wherein the second end of said first cord body is connected with said head portion (363) via a top of said pivoting seat, thereby enabling said head portion to urge an underside of said pivoting seat when the sliding member moves away from the head portion.

* * * * *